US005758870A

United States Patent [19]

Weaver

[11] Patent Number: 5,758,870

[45] Date of Patent: Jun. 2, 1998

[54] ERGONOMIC CLAMP PIN HANDLE COVER

[75] Inventor: Michael L. Weaver, Acworth, Ga.

[73] Assignee: Mega Technology E.D.M., Inc., Norcross, Ga.

[21] Appl. No.: 646,049

[22] Filed: May 7, 1996

[51] Int. Cl.[6] ..... B25B 1/12

[52] U.S. Cl. ..... 269/329; 269/239; 269/249; 269/285

[58] Field of Search ..... 269/239, 249, 269/285, 329; 16/116 A, DIG. 12; D8/71, 72, 73, 80, 303, 321, 322; 150/161

[56] References Cited

U.S. PATENT DOCUMENTS

| | | | |
|---|---|---|---|
| 2,274,605 | 2/1942 | Hoffmeister . | |
| 2,512,528 | 6/1950 | Holman | 269/249 |
| 2,519,107 | 8/1950 | Brown | 269/249 |
| 2,725,086 | 11/1955 | Keyes . | |
| 3,997,152 | 12/1976 | Sass et al. | 269/249 |
| 4,074,899 | 2/1978 | Hochstetler | 269/249 |
| 4,396,217 | 8/1983 | Hodgson et al. . | |
| 4,729,587 | 3/1988 | Ward . | |
| 4,811,637 | 3/1989 | McCleary . | |
| 4,890,355 | 1/1990 | Schulten . | |
| 5,195,212 | 3/1993 | Colwell . | |

OTHER PUBLICATIONS

Sylvax Catalog, "Jet Clamp System", Jun. 1986.

*Primary Examiner*—Robert C. Watson
*Attorney, Agent, or Firm*—Wallace C. Bair, Esq.

[57] ABSTRACT

A clamp pin handle cover for covering a pin handle of a mechanical clamp. The clamp pin handle cover includes an elongate cover body defining a slot which is adapted to receive the clamp pin handle therein. In one embodiment the clamp pin handle cover is adapted for use with a clamp having a fixed pin handle. In a second embodiment the clamp pin handle cover is adapted for use with a clamp having a translating pin handle with the translating pin handle disposed at its mid position or a translated position.

34 Claims, 3 Drawing Sheets

ERGONOMIC CLAMP PIN HANDLE COVER

TECHNICAL FIELD

The present invention relates generally to tool handle covers and more particularly to a pin handle cover which is ergonomically designed and removably mountable to a clamp pin handle of a clamp to facilitate tightening the clamp.

BACKGROUND OF THE INVENTION

Mechanical clamps are well known and are used extensively by machinists, woodworkers and others. Clamps such as "C" clamps, cantilever clamps and bar clamps are typically used to clamp two or more objects or work pieces together. Clamps are also used to clamp a work piece to an immovable structure so that the work piece can be machined or otherwise acted upon without undesirable movement of the work piece. There are many other uses and modes of use of clamps that are well known.

A clamp such as a "C" clamp is characterized by a "C" shaped clamp frame and an elongate adjustment screw in threaded engagement with a threaded bore defined in the clamp frame. The clamp frame includes a fixed anvil, defining a clamping surface, opposite the threaded bore. The adjusting screw mounts a moving anvil at one end of the screw and a pin handle, to facilitate turning the screw, at the opposite end. The moving anvil is advanced toward the fixed anvil by turning the adjusting screw.

The adjusting screw is typically fabricated of a solid steel rod which is threaded along its length. One end of the rod is adapted to support the moving anvil. The moving anvil is typically mounted by a swivel mount comprising a ball formed at the end of the adjusting screw and a receiving cup formed in the moving anvil opposite the moving anvil clamping surface.

A mounting boss is formed at the other end of the adjusting screw. The mounting boss defines a mounting aperture through which a pin handle is inserted. To ensure strength of the mounting boss when stressed by forces applied to the pin handle the diameters of the mounting aperture and the pin handle are significantly smaller than the dimensions of the mounting boss.

The diameter of the pin handle typically varies with the overall size of the clamp with clamps having small clamping capacity having smaller diameter pin handles. The pin handles may be as small as one sixteenth of an inch to about one quarter of an inch diameter.

The pin handles are supported by the mounting boss such that the longitudinal axis of the pin handle is perpendicular to the longitudinal axis of the adjusting screw.

Pin handles used with clamps are either fixed or are configured to translate with respect to the mounting boss. A translating pin handle is sized to move freely along the length of the pin handle within the mounting aperture of the mounting boss. The diameter of the translating pin handle adjacent its opposed ends is locally enlarged by swaging to provide a bradded end which acts as a stop to prevent the pin handle from falling from the mounting aperture.

Where the pin handle is a fixed pin handle the mounting aperture and pin handle diameters are sized to provide a light drive fit. The fixed pin handle is inserted into the mounting aperture and then positioned at its midpoint with respect to the mounting boss. The mounting boss may then be deformed adjacent the mounting aperture to set the position of the pin handle permanently within the mounting boss.

A cantilevered clamp is another type of clamp which is characterized by opposed arcuate clamping arms which are pivotally mounted about a common pivot point. Each of the clamping arms supports a pivotally mounted clamping jaw which move toward each other as the clamping arms are pivoted toward each other by an adjusting screw. The adjusting screw has one end in fixed yet rotatable engagement with one of the arms. The adjusting screw is also threadedly interconnected with the other arm through a follower attached to but pivotally movable with the opposed clamping arm. As the adjusting screw is rotated the follower moves along the adjusting screw thereby causing the opposed clamping arms to pivot about the pivot point and urging the clamping jaws together.

As with the "C" clamp described above, the adjusting screw of a cantilever clamp is typically provided with a pin handle supported in an aperture defined in a mounting boss formed at an end of the adjusting screw opposite the end in engagement with the clamping arm.

Many other types of clamps also include a threaded rod which supports a pin handle at one end to facilitate turning the screw to tighten the clamp.

In some applications it is desirable to have a clamp with a fixed pin handle. Fixed pin handles are easy to manipulate and encourage uniform tightening of the clamp without twisting the clamp with respect to the object. Fixed pin handles are less likely to unexpectedly, and at times undesirably, contact adjacent objects because the pin handle does not move, regardless of the orientation of the clamp. This is unlike a clamp with a translating pin handle where the pin handle may unexpectedly move especially when the pin handle is rotated in a substantially vertical plane and gravity causes the handle to move within the mounting aperture when a user releases his grip on the pin handle.

In other applications a translating pin handle is desirable. A translating pin handle is capable of providing a longer lever arm by moving the pin handle to one end of its travel within the mounting aperture. The increased lever arm allows a user to apply higher torque to the adjusting screw thereby substantially increasing the clamping pressure applied by the clamp.

Clamps having translating pin handles are oftentimes more versatile in tight places or where objects are close to the clamp. Nearby objects may prevent a full 360° rotation of the adjusting screw because of interference between the pin handle and the nearby objects. In that case, the adjusting screw can be rotated until the translating pin handle comes in contact with the nearby object. Then, the pin handle is moved within the mounting aperture so that pin handle no longer contacts the nearby object. The rotation of the adjusting screw can then continue and the step of moving the pin handle in the mounting aperture is repeated until the clamp is sufficiently tightened.

The clamping pressure exerted by a clamp on a work piece or object is proportional to the tightening torque applied to the adjusting screw. Because the diameter of the pin handle is small the clamp may be uncomfortable to tighten by hand when it is necessary to apply high torque forces to the clamping screw. The relatively small surface area of the user's fingers bearing on the surface of the pin handle while tightening the adjusting screw can result in extremely high pressure applied to the user's fingers. The high pressures give the sensation to the user that the pin handles are "cutting" into the user's hands and fingers which becomes very uncomfortable particularly where the task of tightening, and untightening, a clamp is performed numerous times each day such as may be the case in high volume machining operations. Clamp users may also find that, as they experience discomfort caused by tightening the clamps, they tend not to apply the tightening torque they could apply, and sometimes need to apply, to the clamp. In this situation users often resort to other means for tightening the clamp.

One means for overcoming the discomfort of hand tightening the adjusting screw is to use other handtools such as wrenches and pliers to grasp the pin handle and tighten the clamp. Although the use of handtools is effective, it is often inconvenient to have to pick up a handtool to assist tightening the clamp. Also, the use of hand tools may be unsafe. The use of handtools often leads, unknowingly, to the application of torque higher than the design limits of the pin handle thereby resulting in the pin handle bending or breaking.

Providing clamps with translating pin handles can provide for higher hand tightening torque because of the increased lever arm provided by a pin handle moved to one end of its travel. However, the tightening torque is not evenly balanced about the clamp and the clamp has a tendency to twist from engagement with the work piece. Also, with repeated use of the clamps with translating pin handles, the bradded portions tend to develop a sharp edge extending circumferentially about the brad as a result of the inner portion of the brad being peined after striking the side of the mounting boss. The sharp edges have a tendency to cut into the hands of a user attempting to tighten the clamp, especially where high tightening torque is being applied to the adjusting screw.

Another method of overcoming the discomfort is to provide a larger diameter pin handle. This would, however, require a larger mounting boss which increases the overall weight and balance of the clamp making them heavy, bulky and cumbersome to use. Alternatively, the pin handles could be made longer to provide a longer moment arm. But longer pin handles also tend to be cumbersome to use and difficult to store.

What is needed and what is apparently not available is a clamp pin handle cover adaptable for use with a clamp pin handle that allows a clamp to be tightened by hand within the design limits of the clamp without being uncomfortable to do so by the user.

SUMMARY OF THE INVENTION

The present invention solves the above described problems in the art by providing an ergonomically designed clamp pin handle cover that is adaptable for use with a pin handle of a clamp.

Generally described the apparatus of the present invention provides an elongate cylindrical clamp pin handle cover which is adapted to securely yet removably engage the pin handle of a clamp. In a first embodiment of the present invention, the clamp pin handle cover is adapted for use with a clamp having a fixed pin handle. In a second embodiment of the present invention, the clamp pin handle cover is adapted for use with a clamp having a translating pin handle.

More particularly described, the present invention includes an elongate cylindrical clamp pin handle cover body having a slot formed along the length of the clamp pin handle cover body. The slot extends to a predetermined depth into the clamp pin handle cover body. In a first configuration of the first embodiment of the present invention the slot extends fully between and opens outwardly adjacent to the opposed ends of the clamp pin handle cover body. In a second configuration of the first embodiment of the present invention the slot is a closed-end slot extending between the ends of the clamp pin handle cover but not opening at the ends thereof. In both configurations, the clamp pin handle cover includes a mounting boss receiving bore at a mid portion of the clamp pin handle cover body which is sized and configured to receive the mounting boss of the clamp adjusting screw.

The pin handle cover slot includes opposed parallel sidewalls defining a predetermined slot width, and a circularly shaped wall extending between the sidewalls and defining a predetermined diameter. The diameter of the circularly shaped wall is greater than the width of the spacing between the sidewalls. The sidewalls are spaced apart a distance equal to or slightly less than the diameter of the pin handle. The diameter of the circularly shaped wall is slightly greater than the diameter of the pin handle. The configuration and dimensions of the slot allow the clamp pin handle cover to "snap" into engagement with the pin handle and resist unintended movement of the clamp pin handle cover from the clamp pin handle.

In the second embodiment of the present invention, the clamp pin handle cover defines first and second boss receiving bores. The first boss receiving bore is located at a mid-point of the clamp pin handle cover. The second boss receiving bore is located adjacent to but spaced apart from an end of the clamp pin handle cover. The clamp pin handle cover of the second embodiment of the present invention is thus engagable with the translating pin handle positioned at a mid position or with the translating clamp pin handle positioned at a translated position.

The clamp pin handle cover of the present invention provides a clamp pin handle cover which presents a pressure surface substantially greater in area than the pressure surface provided by the pin handle alone. The increased area provided by the clamp pin handle cover of the present invention is more comfortable to use because the reactive tightening torque forces are distributed over a larger surface area of the user's hand and fingers. This lowers the pressure applied to the user's hands and fingers.

Advantageously, the clamp pin handle cover of the present invention is removable. The advantage of being removable is that the clamp can be tightened comfortably by the user and then the clamp pin handle cover can be removed so that the clamp and work piece may be used in environments which would be detrimental to the material of which the clamp pin handle cover is fabricated. Such an environment may include a heated environment or a solvent environment for example. Also, a single clamp pin handle cover may be used to tighten several clamps having suitable pin handles rather than having a pin handle cover for each and every clamp. Thus, removability of the clamp pin handle cover contributes to the economical use of the present invention.

Therefore, it is an object of the present invention to provide a clamp pin handle cover adaptable for use with a clamp having an adjusting screw and a pin handle supported by the adjusting screw.

It is another object of the present invention to provide a clamp pin handle cover which may be securely yet removably mounted to a fixed pin handle of a clamp.

It is further object of the present invention to provide a clamp pin handle cover that is adaptable for use with a translating clamp pin handle.

It is still another object of the present invention to provide a clamp pin handle cover that is comfortable to use.

It is another object of the present invention to provide a clamp pin handle cover which is inexpensive and economical to use.

Other objects, advantages and features of the present invention will be more readily understood from the following detailed description of specific embodiments thereof when read in conjunction with the accompanying drawings.

DETAILED DESCRIPTION

Figure 1:
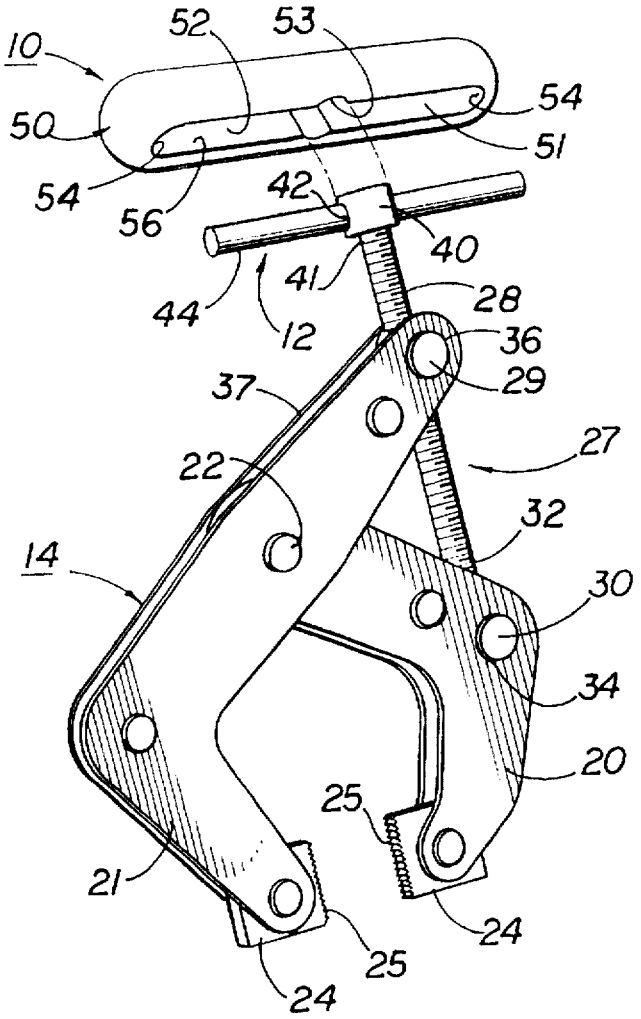
FIG. 1 is a perspective view of a first embodiment of the clamp pin handle cover of the present invention destined to be engaged with a fixed pin handle of a cantilever clamp.
Figure 5:
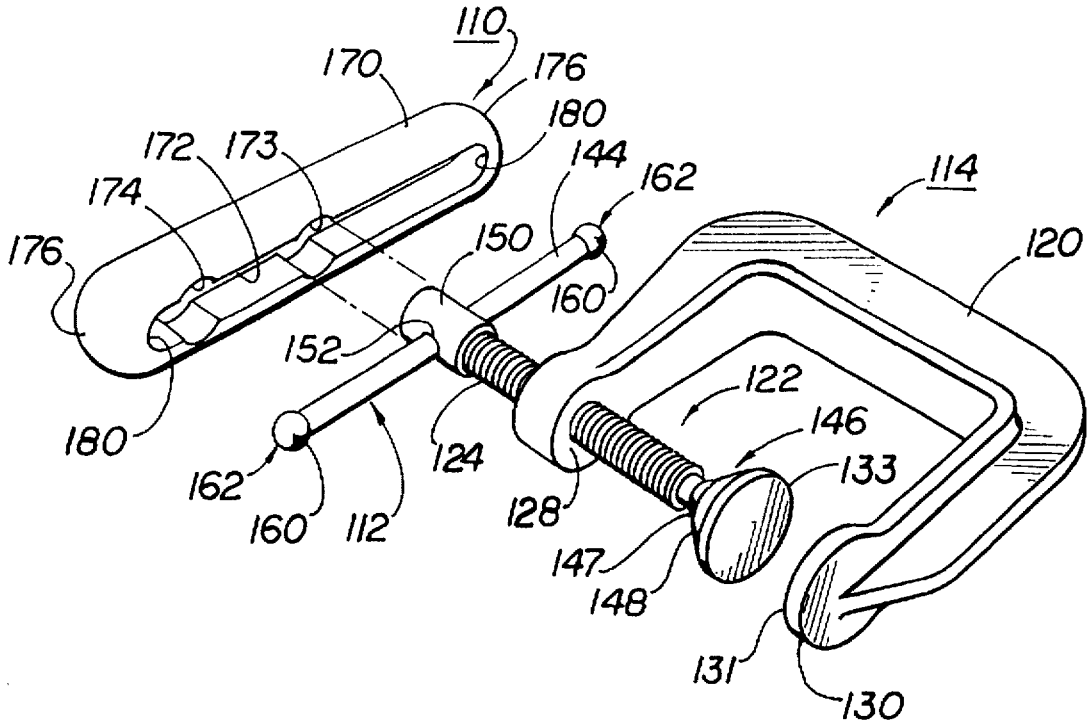
FIG. 5 is a perspective view of a second embodiment of the clamp pin handle cover of the present invention destined to be engaged with a "C" clamp having a translating pin handle.

Referring now in more detail to the drawings, in which like numerals refer to like parts throughout the several views, FIG. 1 shows a first embodiment of a clamp pin handle cover 10 of the present invention destined to be mounted on a fixed pin handle assembly 12 of a clamp 14. In FIG. 5 there is shown a second embodiment of a clamp pin handle cover 110 of the present invention destined to be mounted on a translating pin handle assembly 112 of a "C" clamp 114.

The clamp 14 is a cantilever clamp known commonly as a "Kant Twist" brand clamp manufactured by Clamp Manufacturing Co., Inc. of South El Monte, Calif. The clamp 14 includes opposed arcuate clamping arms 20 and 21 which are pivotally mounted about a common pivot point by a pivot pin 22. Each of the clamping arms 20 and 21 supports a pivotally mounted clamping jaw 24, each of which defines a clamping surface 25. The clamping arms 20 and 21 are operatively interconnected with each other by the fixed pin handle assembly 12 which includes an adjusting screw 28, and an adjusting assembly 27 which includes a follower 29 and a screw hub 30. The adjusting screw 28 has a first end 32 in fixed yet rotatable engagement with the screw hub 30 which is supported in pivotal engagement with the first clamping arm 20 by apertures 34 defined in the clamping arm 20. The adjusting screw 28 is also threadedly interconnected with clamping arm 21 through the follower 29 which is supported in pivotal engagement with the second clamping arm 21 by apertures 36 defined in a cantilevered extension 37 of the clamping arm 21.

The adjusting screw 28 includes a pin handle mounting boss 40 formed at a free end 41 of the adjusting screw 28. The mounting boss 40 defines a mounting aperture 42 which extends through the mounting boss 40 such that a longitudinal axis of the aperture 42 is perpendicular to the longitudinal axis of the adjusting screw 28. A pin handle 44 is supported in the mounting aperture 42 at a fixed position. The length of the pin handle 44 extending from the mounting aperture 42 at one side of the mounting boss 40 is substantially equal to the length of the pin handle 44 extending from the mounting aperture 42 on the opposite side of the mounting boss 40. The pin handle 44 is an elongate metal rod having opposed plane cut ends.

The clamp 14 is actuated by rotating the adjusting screw 28 which causes the clamping arms 20 and 21 to pivot about the pivot pin 22. As the clamping arms 20 and 21 pivot relative to each other the distance between the clamping surfaces 25 of the clamping jaws 24 decreases or increases depending on the direction of rotation of the adjusting screw 28.

It should be understood to those skilled in the art that the cantilever clamp 14 shown in FIG. 1 is only illustrative of a type of clamp having a fixed pin handle. Its use and description is not meant in any way to act as a limitation of the present invention. It will thus be appreciated that the clamp pin handle cover 10 is adaptable to other clamps having fixed pin handles.

Figure 2:
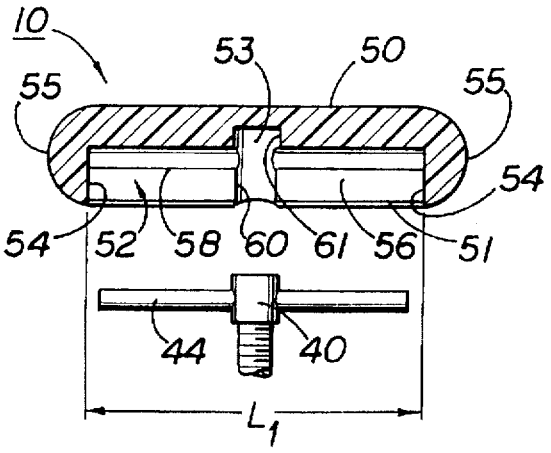
FIG. 2 is a cross-sectional side view of a clamp pin handle cover adaptable for use with a fixed pin handle and having a closed end pin handle receiving slot.
Figure 2A:
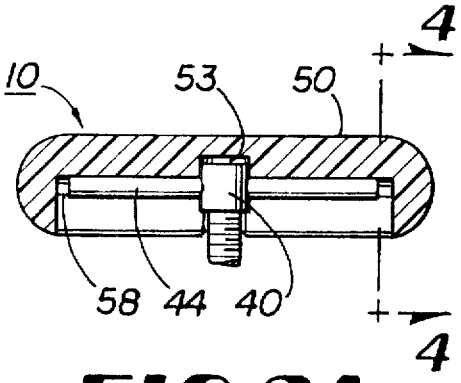
FIG. 2A is a cross-sectional side view of the clamp pin handle cover of FIG. 2 shown in seated engagement with the pin handle and pin handle mounting boss.

As shown in FIG. 2, the clamp pin handle cover 10 includes an elongate cover body 50 which defines a slot 52 having a slot opening 51, the slot 52 and the slot opening 51 extending along the length of the cover body 50. The clamp pin handle cover 10 further includes and a boss receiving bore 53 located at a mid portion of the cover body 50 and coincident with and intersecting the slot 52. In the preferred embodiment of the present invention the clamp pin handle cover 10 is fabricated of molded thermoplastics such as polyvinylchloride (PVC) or acrylonitrilebutadiene styrene (ABS) or polypropylene (PP) for example. Any suitable material may also be used and the above identified materials are not intended to be limiting. The exterior surface of the cover body 50 may be smooth or may be provided with a rough or textured surface to enhance gripping the clamp pin handle cover 10.

Figure 3:
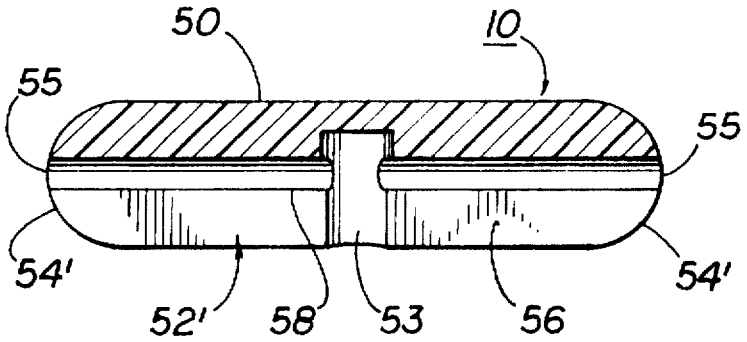
FIG. 3 is a cross-sectional side view of a clamp pin handle cover adaptable for use with a fixed pin handle and having an open-end pin handle receiving slot.

The slot 52 may be a closed end slot, as shown in FIG. 2, having opposed slot ends 54. As shown in FIG. 3, the slot 52 may be an opened end slot, designated as 52', having opposed slot ends 54' that open outwardly adjacent opposed ends 55 of the cover body 50.

Figure 4:
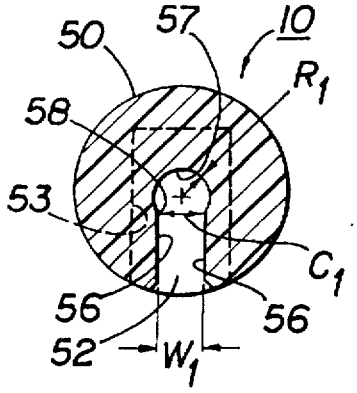
FIG. 4 is a cross-sectional end view, enlarged to show greater detail, of the clamp pin handle cover shown in FIG. 2A, taken along line 4—4, showing the configuration and dimensions of the pin handle receiving slot.

The cross-sectional configuration of the slot 52 and 52' is shown in FIG. 4. It is informative to note at this point that many clamp manufactures manufacture clamps having pin handles that are consistently sized and configured and vary in size and configuration only slightly within allowable manufacturing tolerances. Thus, the pin handle diameter $D_1$ and the length of the portion of the pin handle extending from the opposed sides of the mounting boss 40 tend to be consistent within a manufacture's product line.

The slots 52 and 52' include opposed, substantially perpendicular, slot sidewalls 56 and a circularly shaped top wall 57 which joins the sidewalls 56 at a junction 58. The width $W_1$ of the slots 52 and 52' is determined according to the pin handle diameter $D_1$ and, in the preferred embodiment, is equal to the pin handle diameter $D_1$. Alternatively, the width $W_1$ may be slightly less than the pin handle diameter $D_1$, in the range of 0.001 to 0.005 inches. Where the slot width $W_1$ is slightly less than the pin handle diameter $D_1$ the resiliency of the plastic used to fabricate the clamp pin handle cover 10 allows the slot sidewalls 56 to part slightly to accommodate an interference fit between the pin handle 44 and the slot sidewalls 56 when the clamp pin handle cover 10 is engaged with the clamp pin handle 44.

Figure 8:
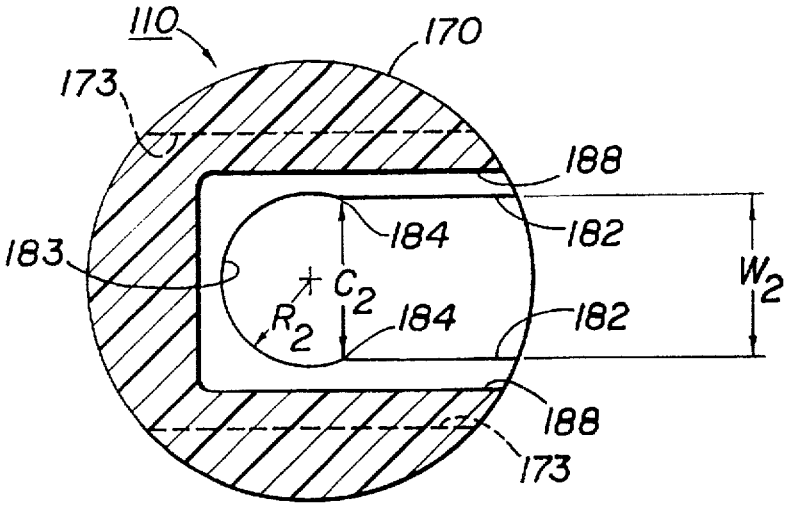
FIG. 8 is a cross-sectional end view, enlarged to show greater detail, of the clamp pin handle cover shown in FIG. 7 taken along line 8—8.

The circularly shaped top wall 57 is sized and configured with a radius of curvature $R_1$ slightly greater than the radius of the pin handle 44 for which the clamp pin handle cover 10 is designed and intended to fit. As is shown in FIGS. 4 and 8 the circularly shaped wall 57 or 183, respectively, includes a circular displacement of greater than 180° which allows the pin handle cover to reside adjacent the circularly shaped top wall 57 or 183 without engaging the slot sidewalls 56 or 182, respectively. For example, a common diameter $D_1$ for a fixed pin handle 44 adapted to a cantilever clamp 12 such as that shown in FIG. 1 is 0.125 inches diameter. A clamp pin handle cover 10 for use with this clamp would have a slot width $W_1$ substantially equal to 0.125 inches, although the width $W_1$ may be slightly undersized. The radius of curvature $R_1$ of the circularly shaped top wall 57 is slightly larger than the corresponding pin handle diameter $D_1$ (2 times $R_1$), for example, about 0.001 to 0.005 inches larger, or 0.002 to 0.010 on the diameter. The length $C_1$ of the chord extending between the opposed junctions is equal to the slot width $W_1$ which is 0.125 inches. The relative dimensions of the slot width $W_1$ and the radius of curvature $R_1$ allows the clamp pin handle cover 10 to engage the pin handle 44 with a snap as the pin handle moves through the slot 52 adjacent the sidewalls 56 and seats with n the circularly shaped top wall 57.

The boss receiving bore 53 is sized and configured to receive the mounting boss 40 therein. The boss receiving bore 53 comprises partial arcuate sidewalls 60 and a circularly shaped upper bore portion 61. The boss receiving bore 53 provides the necessary clearance between the mounting boss 40 and the clamp pin handle cover 10 so that the fixed pin handle 44 properly seats within the circular sidewall portion 57 of the slot 52. The diameter of the boss receiving bore 53 is slightly greater than the diameter of the mounting boss 40 to provide a clearance fit therebetween.

The length $L_1$ of the slot 52 of the closed end clamp pin handle cover shown in FIG. 2 is greater than the length of the fixed pin handle 44. The slot length $L_1$ is made longer than the length of the pin handle 44 to allow the easy positioning of the clamp pin handle cover 10 on the fixed pin handle assembly 12. In the embodiment of the clamp pin handle cover shown in FIG. 2, mechanical engagement of the opposed ends of the pin handle 44 with the clamp pin handle cover 10 is not necessary to effect the attachment of the clamp pin handle cover 10 to the fixed pin handle 44. Also, after manufacturing of the fixed pin handle clamp 14, the length of the pin handle 44 extending from opposite sides of the mounting hub 40 may differ, at times as much of ⅛ of an inch.

Referring now to FIGS. 5 and 6–8 the clamp pin handle cover 110 adapted for use with a "C" clamp 114 is shown. The "C" clamp includes a generally "C" shaped clamp frame 120 and an adjustment assembly 122. The adjustment assembly 122 comprises an elongate threaded adjusting screw 124 in threaded engagement with a threaded boss 128 defined in the clamp frame 120. The clamp frame 120 includes a fixed anvil 130, defining a clamping surface 131, opposite the threaded boss 128. The adjusting screw 124 mounts a moving anvil 133 at one end of the screw and a translating pin handle 144, to facilitate turning the screw, at the opposite end. A swivel mount 146 mounts the moving anvil 133 to the end of the adjusting screw 124. The swivel mount 146 comprises a ball 147 formed at the end of the adjusting screw 124 and a receiving cup 148 formed in the moving anvil 133.

A translating pin handle mounting boss 150 is formed at the end of the adjusting screw 124 opposite the moving anvil 133. The mounting boss 150 defines a mounting aperture 152 extending through the mounting boss 150 such that a longitudinal axis of the mounting aperture 152 is perpendicular to the longitudinal axis of the adjustment screw 124. The overall height of the mounting boss 150 of a "C" clamp with a translating pin handle is greater than that of cantilever clamps described above.

The translating pin handle 144 is received for translation within the mounting aperture 152. The pin handle 144 may be as small as one sixteenth of an inch to about one quarter of an inch diameter depending on the rating of the clamp. To prevent the pin handle 144 from falling from the mounting aperture 152, brads 160 are formed on opposed ends 162 of the pin handle 144. The diameter of the brad is greater than the diameter of the mounting aperture 152.

Figure 6:
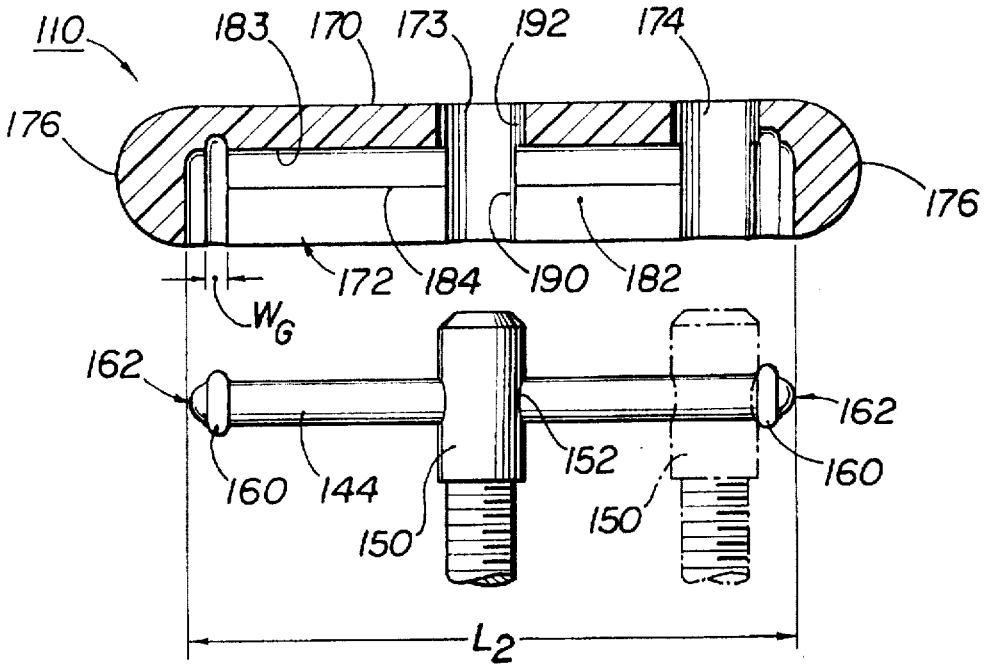
FIG. 6 is a cross-sectional side view of the clamp pin handle cover shown in FIG. 5 destined to be engaged with a clamp pin handle in a mid position and a translated position shown in phantom lines.

The translation of the pin handle 144 within the mounting aperture 152 is depicted in FIG. 6 which shows the pin handle 144 at two positions—a first, mid position, and a second, fully translated position, shown in phantom lines.

The clamp pin handle cover 110 includes an elongate cover body 170 which defines a slot 172, extending along the length of the cover body 170, and first and second boss receiving bores 173 and 174. Boss receiving bore 173 is located at a mid portion of the cover body 170. Boss receiving bore 174 is located adjacent an end 176 of the cover body 170. Each of the boss receiving bores 173 and 174 extends fully through the cover body 170 unlike the boss receiving bore 52 described above which is closed ended at one end thereof. It is to be understood that the clamp pin handle cover 110 may be provided with only a single boss receiving bore 173 or 174 and in such cases would be adaptable for use with the translating pin handle 144 in only its mid position or translated position, respectively.

In the preferred embodiment of the present invention the clamp pin handle cover 110 is fabricated of molded thermoplastics such as polyvinylchloride (PVC) or acrylonitrilebutadiene styrene (ABS) or polypropylene (PP) for example. Any suitable material may also be used and the above identified materials are not intended to be limiting. The exterior surface of the cover body 170 may be smooth or may be provided with a rough or textured surface to enhance gripping the clamp pin handle cover 110.

Figure 7:
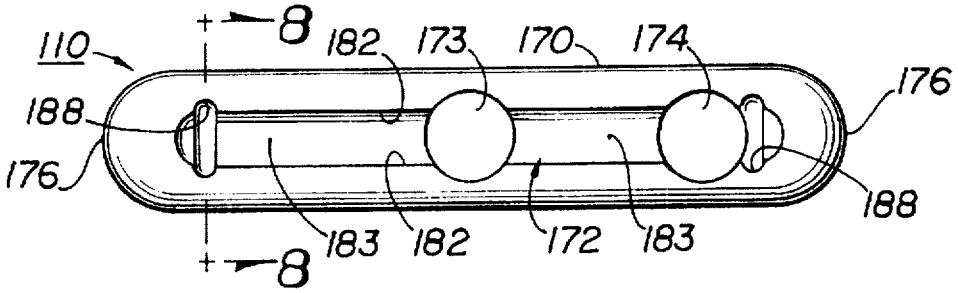
FIG. 7 is a bottom view of the clamp pin handle cover shown in FIG. 6.

The slot 172 may be a closed end slot as shown in FIGS. 5–7 having opposed slot ends 180. Alternatively, the slot 172 may be an opened end slot, similar to that shown in FIG. 3 in all substantial details related to the slot configuration.

The cross-sectional configuration of the slot 172 is shown in FIG. 8. The slot 172 comprises opposed slot sidewalls 182 and a circularly shaped top wall 183 which joins the sidewalls 182 at a junction 184. The slot width $W_2$ is determined according to the translating pin handle diameter $D_2$ and, in the preferred embodiment, is equal to the pin handle diameter $D_2$or slightly smaller, in the range of 0.001 to 0.005 inches. Where the slot width $W_2$ is undersized the resiliency of the plastic used to fabricate the clamp pin handle cover 110 allows the slot sidewalls 182 to accommodate an interference fit between the pin handle 144 and the slot sidewalls 182 when the clamp pin handle cover 110 is engaged with the clamp pin handle 144.

The circularly shaped top wall 183 is sized and configured with a radius of curvature $R_2$ slightly greater than the radius of the pin handle 144 for which the clamp pin handle cover 110 is designed and intended to fit. For example, a common diameter $D_2$ for a translating pin handle 44 adapted to a "C" clamp 112 such as that shown in FIG. 5 is 0.250 inches diameter. A clamp pin handle cover 110 for use with this clamp would have a slot width $W_2$ substantially equal to 0.250 inches, although the width $W_2$ may be slightly undersized. The radius of curvature $R_2$ of the circularly shaped top wall 183 would be greater that the pin handle diameter $D_2$, such as for example about 0.005 inches or 0.010 on the diameter. The length $C_2$ of the chord extending between the opposed junctions 184 is equal to the slot width $W_2$ which is 0.25 inches diameter. The relative dimensions of the slot width $W_2$ and the radius of curvature $R_2$ allows the clamp pin handle cover 110 to engage the pin handle 144 with a snap.

The slot 172 is also provided with opposed, "U" shaped grooves 188 adjacent the opposed ends 176 of the clamp pin handle cover 110 to provide clearance for the brads 160 formed at the ends of the pin handle 144. The width $W_G$ of the grooves 188 can be made wider to accommodate clamps having translating pin handles of different lengths.

The mounting boss receiving bores 173 and 174 are sized and configured to receive the mounting boss 150 therein. Thus, the diameters of the boss receiving bores 173 and 174 are slightly greater than the diameter of the mounting boss 150. The boss receiving bores 173 and 174 comprise partial arcuate sidewalls 190 and a circularly shaped upper bore portion 192 adjacent bore openings 193 and 194. The boss receiving bores 173 and 174 may be configured to open outwardly of the clamp pin handle body 170 opposite the slot 172 as shown in FIG. 6.

Boss receiving bore 173 is positioned in the center of the clamp pin handle cover body 170 so that the clamp pin handle cover 110 fits the clamp 114 with the translating pin handle 144 positioned at its central position.

At times it is desirable to translate the pin handle 144 fully to one end of its travel to provide a greater lever arm for applying clamping pressure. In this position the clamp pin handle cover 110 is adapted to the pin handle assembly 112 by positioning the mounting hub 150 within the boss receiving bore 174 and the pin handle 144 in the slot 172.

The length $L_2$ of the slot 172 of the clamp pin handle cover 110, shown in FIG. 6, is slightly greater than the length of the translating pin handle 144. The width $W_G$ of the grooves 188 can be made wider to accommodate clamps having translating pin handles of shorter length than $L_2$ since clearance must be provided for the brads 160 regardless of the length $L_2$ of the translating pin handle 144.

While the present invention in its various aspects has been described in detail with regard to preferred embodiments thereof, it should be understood that variations, modifications and enhancements can be made to the disclosed apparatus and procedures without departing from the spirit and scope of the present invention as defined in the appended claims.

What is claimed is:

1. A clamp pin handle cover adapted to engage a clamp pin handle of a clamp, the clamp pin handle of the clamp being supported by a clamp boss and having a predetermined pin handle diameter and radius, comprising:

an elongate cover body, said cover body defining a slot having a slot opening, said slot and said slot opening extending longitudinally along a portion of the length of said cover body, and a boss receiving bore, said boss receiving bore being disposed in said cover body coincident with said slot said cover body including first and second opposed sidewalls and a top wall extending from said first sidewall to said second sidewall and coincident therewith, said sidewalls and said top wall defining said slot, said cover body being adapted to receive the clamp pin handle through said slot opening, within said slot, and said boss receiving bore being adapted to receive the clamp boss within said boss receiving bore, when said clamp pin handle cover is engaged with the clamp pin handle thereby covering the clamp pin handle, and said sidewalls being spaced a predetermined sidewall width apart to prevent unintended movement of said pin handle cover relative to the pin handle when the clamp pin handle resides within said slot.

2. The apparatus of claim 1 wherein said boss receiving bore is located at a midpoint of said cover body.

3. The apparatus of claim 1 wherein said slot is a closed end slot.

4. The apparatus of claim 1 wherein said slot is an opened end slot, said opened end slot opening outwardly of said cover body.

5. The apparatus of claim 1 wherein said predetermined sidewall width is substantially equal to the predetermined pin handle diameter such that an interference fit between said pin handle and said first and second opposed sidewalls exists when the clamp pin handle is positioned between said first and second opposed sidewalls.

6. The apparatus of claim 1 wherein said predetermined sidewall width is less than the predetermined pin handle diameter such that an interference fit between said pin handle and said first and second opposed sidewalls exists when the clamp pin handle is positioned between said first and second opposed sidewalls.

7. The apparatus of claim 6 wherein said predetermined sidewall width is between 0.001 to 0.005 inches less than the predetermined pin handle diameter.

8. A clamp pin handle cover adapted to engage a clamp pin handle of a clamp, the clamp pin handle being supported by a clamp boss and wherein the clamp pin handle is a translating pin handle supported for translation within a mounting aperture defined by the clamp boss, the clamp pin handle being positionable at a translated position with respect to the clamp boss such that when the clamp pin handle is positioned at the translated position an end of the clamp pin handle is located adjacent to the clamp boss, said clamp pin handle cover comprising:

an elongate cover body, said cover body defining a slot, said slot extending along a portion of the length of said cover body and defining a slot opening extending longitudinally along said cover body, and a boss receiving bore defined by said cover body disposed coincident with said slot and located adjacent an end of said cover body, wherein said slot and said boss receiving bore are adapted to receive the clamp pin handle and the clamp boss, respectively, therein when the translating clamp pin handle is disposed in the translated position and the clamp pin handle cover is engaged with said clamp pin handle thereby covering the clamp pin handle.

9. A clamp pin handle cover adapted to engage a clamp pin handle of a clamp the clamp pin handle being supported by a clamp boss and wherein the clamp pin handle is a translating clamp pin handle supported for translation within a mounting aperture defined by the clamp boss, the clamp pin handle being positionable between a mid position and a translated position with respect to the clamp boss such that when the clamp pin handle is positioned at the translated position an end of the clamp pin handle is adjacent to the clamp boss, said clamp pin handle cover comprising:

an elongate cover body, said cover body defining a slot, said slot extending along a portion of the length of said cover body and defining a slot opening extending longitudinally along said cover body, and first and second boss receiving bores defined by said cover body, said first and second boss receiving bores being coincident with said slot and wherein said first boss receiving bore is located at a mid position of said cover body and said second boss receiving bore is located adjacent an end of said cover body, wherein said slot and said first boss receiving bore are adapted to receive the clamp pin handle and the clamp boss, respectively, therein when the translating clamp pin handle is disposed at the mid position and the clamp pin handle cover is engaged with said clamp pin handle, and wherein said slot and said second boss receiving bore are adapted to receive the clamp pin handle and the clamp boss, respectively, therein when the translating pin handle is disposed in the translated position and the clamp pin handle cover is engaged with said clamp pin handle thereby covering the clamp pin handle.

10. The apparatus of claim 1 wherein said slot and said slot opening are configured such that said cover body is disposed in engagement with the clamp pin handle by laterally moving said cover body into engagement with the clamp pin handle so that the clamp pin handle is received in said slot through said slot opening.

11. The apparatus of claim 8 wherein said slot is a closed end slot.

12. The apparatus of claim 8 wherein said slot is an opened end slot, said opened end slot opening outwardly of said cover body.

13. The apparatus of claim 8 wherein said cover body includes first and second opposed sidewalls and a top wall extending from said first sidewall to said second sidewall and coincident therewith, said sidewalls and said top wall defining said slot, said sidewalls being spaced a predetermined sidewall width apart to prevent unintended movement of said pin handle cover from the pin handle when the pin handle cover is disposed in covering engagement with the pin handle.

14. The apparatus of claim 13 wherein said top wall of said slot is circularly configured.

15. The apparatus of claim 14 wherein the pin handle of the clamp has a predetermined pin handle diameter and radius and wherein said circularly configured top wall defines a radius of curvature greater than the predetermined pin handle radius.

16. The apparatus of claim 13 wherein the pin handle of the clamp comprises a predetermined pin handle diameter and wherein said predetermined sidewall width is substantially equal to the predetermined pin handle diameter such that an interference fit between said pin handle and said first and second opposed sidewalls exists when the clamp pin handle is positioned between said first and second opposed sidewalls.

17. The apparatus of claim 13 wherein the pin handle of the clamp has a predetermined pin handle diameter and wherein said predetermined sidewall width is less than the predetermined pin handle diameter such that an interference fit between said pin handle and said first and second opposed sidewalls exists when the clamp pin handle is positioned between said first and second opposed sidewalls.

18. The apparatus of claim 17 wherein said predetermined sidewall width is between 0.001 to 0.005 inches less than the predetermined pin handle diameter.

19. The apparatus of claim 9 wherein said slot is a closed end slot.

20. The apparatus of claim 9 wherein said slot is an opened end slot, said opened end slot opening outwardly of said cover body.

21. The apparatus of claim 9 wherein said cover body includes first and second opposed sidewalls and a top wall extending from said first sidewall to said second sidewall and coincident therewith, said sidewalls and said top wall defining said slot, said sidewalls being spaced a predetermined sidewall width apart to prevent unintended movement of said pin handle cover from the pin handle when the pin handle cover is disposed in covering engagement with the pin handle.

22. The apparatus of claim 21 wherein said top wall of said slot is circularly configured.

23. The apparatus of claim 22 wherein the pin handle of the clamp has a predetermined pin handle diameter and radius and wherein said circularly configured top wall defines a predetermined radius of curvature greater than the predetermined pin handle radius.

24. The apparatus of claim 21 wherein the pin handle of the clamp comprises a predetermined pin handle diameter and wherein said predetermined sidewall width is substantially equal to the predetermined pin handle diameter such that an interference fit between said pin handle and said first and second opposed sidewalls exists when the clamp pin handle is positioned between said first and second opposed sidewalls.

25. The apparatus of claim 21 wherein the pin handle of the clamp has a predetermined pin handle diameter and wherein said predetermined sidewall width is less than the predetermined pin handle diameter such that an interference fit between said pin handle and said first and second opposed sidewalls exists when the clamp pin handle is positioned between said first and second opposed sidewalls.

26. The apparatus of claim 25 wherein said predetermined sidewall width is between 0.001 to 0.005 inches less than the predetermined pin handle diameter.

27. The apparatus of claim 1 wherein said top wall of said slot is circularly configured.

28. The apparatus of claim 27 wherein said circularly configured top wall defines a radius of curvature greater than the pin handle radius.

29. A clamp pin handle cover adapted to engage a clamp pin handle of a clamp, the clamp pin handle of the clamp being supported by a clamp boss, comprising:

an elongate cover body, said cover body defining a slot having a slot opening, said slot and said slot opening extending longitudinally along a portion of the length of said cover body, and a circularly shaped boss receiving bore sized and configured to receive a circularly shaped boss therein, said boss receiving bore being disposed in said cover body coincident with said slot and defining a longitudinal bore axis transverse to said slot, said cover body being adapted to receive the clamp pin handle through said slot opening, within said slot, and said circularly shaped boss receiving bore being adapted to receive a clamp boss within said circularly shaped boss receiving bore when said clamp pin handle cover is engaged with the clamp pin handle thereby covering the clamp pin handle.

30. A clamp pin handle cover adapted to engage a clamp pin handle of a clamp, the clamp pin handle of the clamp being supported by a clamp boss and, the clamp pin handle being a translating pin handle supported for translation within a mounting aperture defined by the clamp boss, the clamp pin handle being positionable at a translated position with respect to the clamp boss such that when the pin handle is positioned at the translated position an end of the pin handle is adjacent to the clamp boss, comprising:

an elongate cover body, said cover body defining a slot having a slot opening, said slot and said slot opening extending longitudinally along a portion of the length of said cover body, and a boss receiving bore disposed coincident with said slot and located adjacent an end of said cover body, wherein said slot and said boss receiving bore are adapted to receive the clamp pin handle and the clamp boss, respectively, therein when the translating clamp pin handle is disposed in the translated position and the clamp pin handle cover is engaged with said clamp pin handle.

31. A clamp pin handle cover adapted to engage a clamp pin handle of a clamp, the clamp pin handle of the clamp being supported by a clamp boss and, the clamp pin handle being a translating pin handle supported for translation within a mounting aperture defined by the clamp boss, the clamp pin handle being positionable between a mid position and a translated position with respect to the clamp boss such that when the pin handle is positioned at the translated position an end of the pin handle is adjacent to the clamp boss, comprising:

an elongate cover body, said cover body defining a slot having a slot opening, said slot and said slot opening extending longitudinally along a portion of the length of said cover body, and first and second boss receiving bores, said first and second boss receiving bores being coincident with said slot, said first boss receiving bore being located at a mid position of said cover body and said second boss receiving bore being located adjacent an end of said cover body, wherein said slot and said first boss receiving bore are adapted to receive the clamp pin handle and the clamp boss, respectively, therein when the translating clamp pin handle is disposed at the mid position and the clamp pin handle cover is engaged with said clamp pin handle, and wherein said slot and said second boss receiving bore are adapted to receive the clamp pin handle and the clamp boss, respectively, therein when the translating pin handle is disposed in the translated position and the clamp pin handle cover is engaged with said clamp pin handle.

32. The apparatus of claim 1 wherein said clamp pin handle cover is configured to engage the clamp pin handle of the clamp securely yet removably from the clamp pin handle.

33. The apparatus of claim 8 wherein said clamp pin handle cover is configured to engage the clamp pin handle of the clamp securely yet removably from the clamp pin handle.

34. The apparatus of claim 9 wherein said clamp pin handle cover is configured to engage the clamp pin handle of the clamp securely yet removably from the clamp pin handle.

* * * * *